United States Patent [19]

Hellmann

[11] 4,050,373

[45] Sept. 27, 1977

[54] MANUAL TRASH COMPACTOR

[76] Inventor: James J. Hellmann, 6600 SW. 127th St., Miami, Fla. 33156

[21] Appl. No.: 703,352

[22] Filed: July 8, 1976

[51] Int. Cl.[2] ..... B30B 15/06

[52] U.S. Cl. ..... 100/240; 100/229 A; 100/255; 100/265; 100/295

[58] Field of Search ..... 100/295, 229 A, 240, 100/245, 255, 214, 219, 242, 265; 241/99, 168, 169, 169.2; 53/124 B; 141/73.8

[56] References Cited

U.S. PATENT DOCUMENTS

| | | | |
|---|---|---|---|
| 1,671,118 | 5/1928 | Mabee | 100/295 |
| 2,248,108 | 7/1941 | Mihalko | 241/99 |
| 3,107,711 | 10/1963 | Azmus | 241/169.2 |
| 3,779,157 | 12/1973 | Ross | 100/240 |
| 3,903,790 | 9/1975 | Gladwin | 100/245 |

*Primary Examiner*—Billy J. Wilhite
*Attorney, Agent, or Firm*—Leonard W. Suroff

[57] ABSTRACT

A manual trash compactor that has housing means that is adapted to receive therein an exchangeable bag for containing the trash with access means to gain entrance to the bag for depositing of trash within the bag. To compact the trash pressure applying means is provided with a plunger having a compacting head for engagement with the contents of the bag, with gripping means extending outwardly of the housing for moving the plunger axially to reciprocate the head in a compacting direction. Weighting means is associated with the pressure applying means to add weight to the compacting head, and exit means is provided on the housing to permit removal of the compacted bag.

4 Claims, 4 Drawing Figures

MANUAL TRASH COMPACTOR

BACKGROUND OF THE INVENTION

The present invention relates to a manual trash compactor.

Many people now use bags for trash but cannot compress the trash very much without splitting the bag or tipping it over. These bags may be produced from paper as is the case when purchasing food when shopping.

Accordingly, it is common practice to locate relatively small waste receptacles in kitchens, bedrooms, offices or other places where waste collects at a rapid rate, but these receptacles are preferably small and should be of an attractive character. Small receptacles are conventionally employed, but after the same have been in use for a short time, it becomes necessary for the depositor of the waste to follow the same into the receptacle with his hand to compress the contents thereof in order that more waste may be received thereby. Obviously, this objectionable and even unsanitary practice should be obviated, and it is possible so to do through the employment of a compactor made in accordance with the present invention.

Although powered compactors are commercially available, they are both costly as to initial investment and the upkeep as to maintenance and the purchase of bags. Purchasing of the bags can also be an inconvenience since they are not available everywhere.

OBJECTS OF THE INVENTION

An object of the present invention is to provide a compactor to compress trash therein that may be manually operated.

Another object of the present invention is to provide a compactor in which readily available grocery bags may be utilized therein as the container for the trash.

Another object of the present invention is to provide a compactor that is simple to operate for use in homes, offices, hospitals, etc.

Other objects and advantages will become obvious as the disclosure proceeds.

SUMMARY OF THE INVENTION

A manual trash compactor that includes a housing adapted to receive therein as exchangeable bag for containing the trash, with access means associated with the housing to gain entrance thereto for depositing of trash within the bag. Pressure applying means for compacting the trash within the bag is provided and includes a plunger having a compacting head for engagement with the contents of the bas, with means for supporting the plunger for axial movement, and gripping means extending outwardly of the housing for moving the plunger axially to reciprocate the head in a compacting direction.

Weighting means is associated with the pressure applying means to increase the weight thereof to facilitate the compacting of the trash within the bag. Exit means associated with the housing means to provide an opening for removal of the bag filled with compacted trash from within the housing is also provided. The compactor further includes locking means for releasably retaining the pressure applying means at a height relative to the open end of the bag to permit the placement of trash through the access means below the compacting head.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
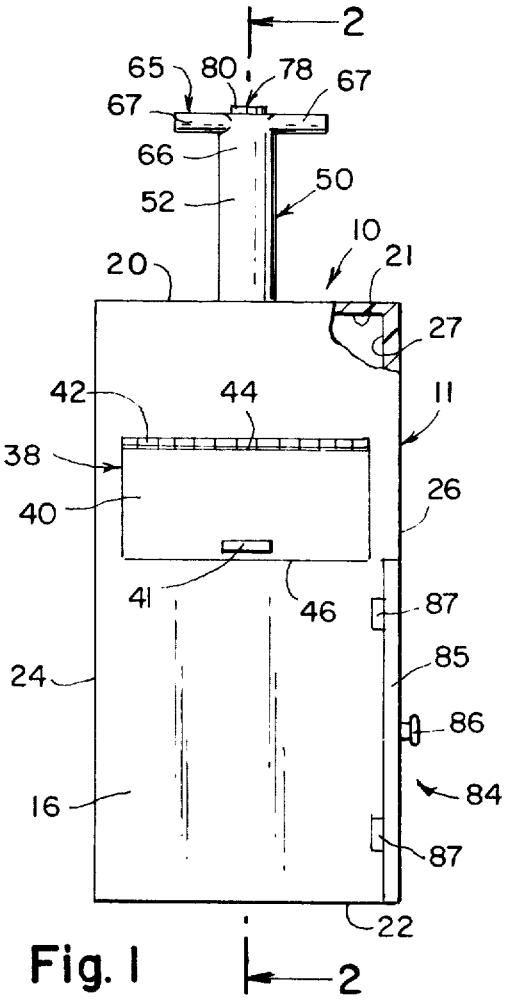
FIG. 1 is a front plan view of the manual trash compactor of the present invention.

Referring to the drawings, FIGS. 1-4 illustrate a compactor 10 for the compression of trash and other waste products disposed therein. The compactor 10 is designed to be manually operated by the user and includes housing means 11 adapted to receive within the housing chamber 12 an exchangeable bag 14 that may be made of paper or plastic material.

The housing means 10, which may be made from plastic, metal or wood, includes a front wall 16 having a front inner surface 17, a rear wall 18 having a rear inner surface 19, a top wall 20 having a top inner surface 21, a bottom wall 22 having a bottom inner surface 23, a left side wall 24 having an inner left surface 25, and a right side wall 26 having an inner right surface 27.

The chamber 12 within the housing 11 is defined by the respective inner surfaces 17, 19, 21, 23, 25 and 27. The bag or receptacle 14 stands upright within the chamber 12 having an open end 32 which may be releasably secured to one or more of the inner surfaces 17, 19, 25, and 27 by a double sided adhesive tape 34 or other convenient manner. The trash 36 is deposited in the bag 14 and from time to time it is compacted as hereinafter explained.

Figure 2:
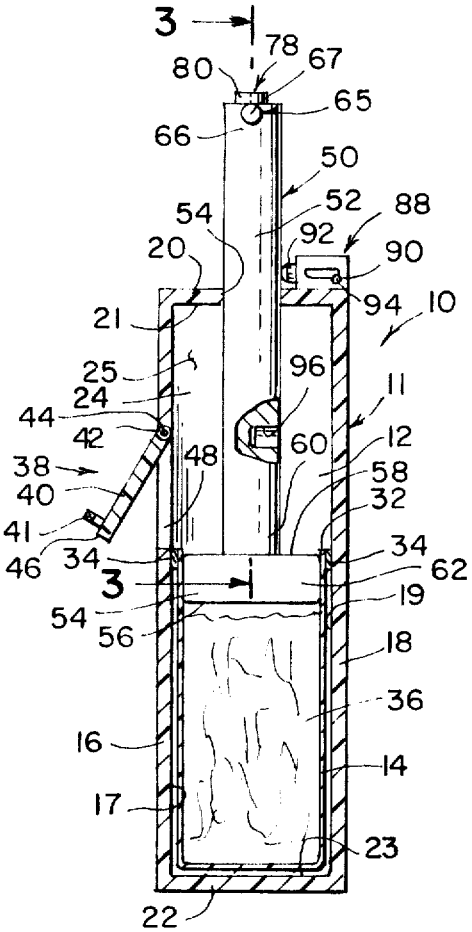
FIG. 2 is a cross-sectional view taken along line 2—2 of FIG. 1.

Access means 38 is provided to permit the user of the compactor 10 to gain entrance to the substantially closed housing means 11. A swinging door 40, having a handle 41, is mounted on the front wall 16 as by a hinge 42 extending along the upper edge 44 of the door 40. The lower edge 46 of the door 40 is at a level as seen in FIG. 2 which is at or above the open end 32 of the bag 14. The door 40 fits within access opening 48 provided on the front wall 16. The particular wall chosen for the door 40 to be located thereon may vary for different models of the compactor 10.

To compact the trash 36 pressure applying means 50 is provided and man include an elongated plunger 52 extending through a mating bore 54 in the top wall 20 which acts as the means for supporting the plunger 52 for axial movement. The plunger 52 may have a cross-section that is square to prevent rotation thereof or in some other manner keyed to maintain proper alignment for the plunger head 54 for axial movement into the open end 32 of the bag 14.

The compacting head 54 has a compacting surface 56 at one side thereof and a spaced apart surface 58 which is secured to the lower end 60 of the plunger 52. The peripheral vertically extending wall 62 of the compacting head 54 is dimensioned so as to enter the open end 32 of the bag 14 with a clearance therebetween. This is to prevent the wall 62 from breaking the bond between the bag 14, and tape 34.

Gripping means 65 is provided at the upper end 66 of the plunger 52 and may include a handle 67 that extends outwardly in both directions of the plunger 52. The handle 67 may be round to facilitate easy grasp by the user of the compactor 10.

Figure 3:
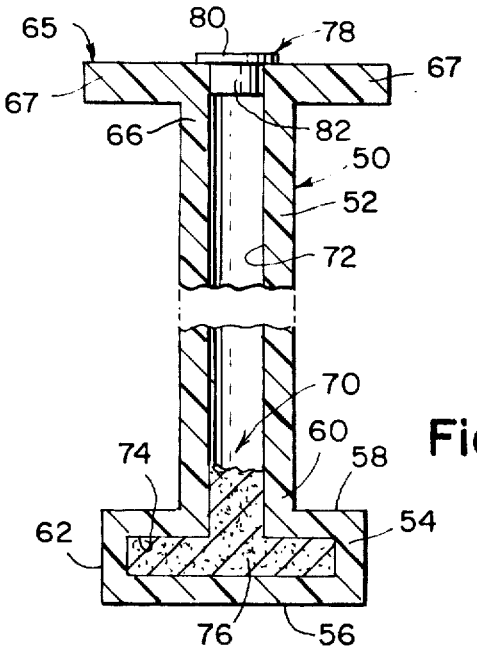
FIG. 3 is a cross-sectional view taken along line 3—3 of FIG. 2.
Figure 4:
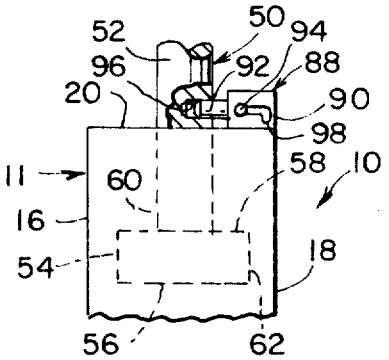
FIG. 4 is a fragmentary view partly in section illustrating the plunger in a locked position.

For lost savings in manufacture the pressure applying means 50 may be molded from plastic which is relatively light in weight. Accordingly, weighting means 70, as seen in FIG. 3, is provided to add weight to the compacting head 54, which weight may be added by the user and be related to the type of trash to be compacted and the strength of the individual user. The weighting means 70 includes an axially extending aperture 72 with one end terminating at the upper end 66 of the plunger 52 and the other end communicating with a cavity 74 in the head 54 that may extend substantially across the entire head 54 to distribute the weight of the sand 76 or other material poured into the cavity 74 through the aperture 72. A cap or closure 78 is provided at the upper end 66 of the plunger 52 and may include an enlarged portion 80 and a mating portion 82 that extends within the aperture 72. In this manner the weight of the plunger may be easily adjusted by the user.

Once the bag 14 has been fully compacted, exit means 84 is utilized to permit removal of the bas 14 with compacted trash 36. The exit means 84 has been shown on the right wall 26 and includes a movable panel 85 having a handle 86 and a pair of spaced apart hinges 87. The height of the panel 85 permits the compacted bag 14 to slide out therethrough for disposal thereof. A new bag may also be placed within the chamber 12 and secured in place. The panel 85 may have a slide bolt or other means to retain it in the closed position to prevent it from opening by any pressure applied by the contents of the bag 14 during compaction.

The compactor 10 further includes locking means 88 for releasably retaining the pressure applying means 50 at an elevated height relative to the open end 32 of the bag 14 to permit the placement of trash through the access means 38 and below the head 54.

The locking means 88 includes a latch 90 mounted on the top wall 20 of the housing 11 and includes a locking member 92 that may be spring loaded and activated by a manually operable lever 94 to retain the locking member 92 in releasably extended or retracted position. A recess 96 is contained on the plunger 52 for receiving therein the locking member 92. In the retracted position of the lever 94 within seat 98 the plunger is free to move axially since the locking member 92 is maintained out of bridging relation with the plunger 52.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A manual trash compactor comprising:

a. a housing adapted to receive therein an exchangeable bag for containing the trash;

b. access means associated with said housing to gain entrance thereto for depositing of trash within the bag, said access means includes a hingeably mounted door on the front of said housing;

c. pressure applying means for compacting the trash within the bag, said pressure applying means including, i. a plunger having a compacting head for engagement with the contents of the bag, said plunger includes a recess thereon, ii. means for supporting said plunger for axial movement, iii. gripping means extending outwardly of said housing for moving said plunger axially to reciprocate said head in a compacting direction, d. weighting means associated with said pressure applying means to increase the weight thereof to facilitate the compacting of the trash within the bag;

e. said weighting means includes:

i. an aperture axially extending in said plunger, ii. a cavity in said compacting head connected to said aperture at one end thereof to receive therein sand or other material for weight, and iii. a cap for closing off said aperture at the other end thereof, f. exit means associated with said housing to provide an opening for removal of the bag filled with compacted trash from within said housing, said exit means includes a hingeably mounted panel on one side of said housing adjacent to the bag so as to permit the removal of the bag with the compacted trash contained therein;

g. locking means for releasably retaining said pressure applying means at a height relative to the open end of the bag to permit the placement of trash through said access means below said compacting head;

h. said locking means includes a latch which is adapted to retain said plunger in a releasably fixed position; and i. said latch includes a member movable between an extended position within said recess for locking said pressure applying means in a fixed position, to a retracted position out of bridging relation with said plunger, said latch member being spring loaded to automatically enter said recess at the desired level of said plunger.

2. A manual trash compactor as defined in Claim 1, wherein said gripping means includes a handle extending outwardly from said plunger.

3. A manual trash compactor as defined in claim 1, further including means for releasably securing the open end of the exchangeable bag within said housing during operation of said pressure applying means.

4. A manual trash compactor as defined in claim 3, wherein said securing means includes a layer of double sided adhesive tape adjacent the open end of the bag.

* * * * *